US005739840A

United States Patent [19]

Imai

[11] Patent Number: 5,739,840

[45] Date of Patent: Apr. 14, 1998

[54] METHOD OF AND DEVICE FOR THERMAL RECORDING

[75] Inventor: Shinji Imai, Kanagawa-ken, Japan

[73] Assignee: Fuji Photo Film Co., Ltd., Kanagawa, Japan

[21] Appl. No.: 625,130

[22] Filed: Apr. 1, 1996

[30] Foreign Application Priority Data

Mar. 31, 1995 [JP] Japan ..... 7-074997
Mar. 31, 1995 [JP] Japan ..... 7-075047

[51] Int. Cl.[6] ..... B41J 2/47

[52] U.S. Cl. ..... 347/232; 347/212; 347/133

[58] Field of Search ..... 347/232, 212, 347/207, 133

[56] References Cited

U.S. PATENT DOCUMENTS 4,561,789 12/1985 Saito ..... 400/120
4,734,704 3/1988 Mizutani et al. ..... 346/76 PH
4,888,601 12/1989 Inui ..... 346/76 PH
5,550,571 8/1996 Shoji ..... 347/207
5,552,818 9/1996 Agano ..... 347/133

*Primary Examiner*—Mark J. Reinhart
*Attorney, Agent, or Firm*—Sughrue, Mion, Zinn, Macpeak & Seas, PLLC

[57] ABSTRACT

Information is recorded on a heat-sensitive recording material including a photo-thermo conversion agent which converts supplied light energy into heat energy, a developing agent and a color forming agent which is encapsuled in micro-capsules whose permeability to materials increases with increase in said heat energy and forms a color by reaction with the developing agent. The photo-thermo conversion agent is localized in and/or on the micro-capsules. The heat-sensitive recording material is heated by supplying the heat-sensitive recording material with heat energy less than energy necessary to cause the heat-sensitive recording material to form a color. A light beam modulated according to the information to be recorded is caused to scan the recording material.

10 Claims, 7 Drawing Sheets

PRIOR ART

METHOD OF AND DEVICE FOR THERMAL RECORDING

BACKGROUND OF THE INVENTION

1. Field of the Invention

This invention relates to a method of and device for thermally recording an image or the like on a heat-sensitive recording medium with the recording medium preheated.

2. Description of the Related Art

There has been put into wide use a thermal recording which records an image or the like on a heat-sensitive recording medium by applying heat energy to the recording medium. Recently there has been developed a thermal recording device in which a laser is employed as a heat source, thereby making it feasible to effect high speed recording. See, for instance, Japanese Unexamined Patent Publication Nos. 50(1975)-23617, 58(1983)-94494, 62(1987)-77983 and 62(1987)-78964.

We have disclosed a heat-sensitive recording material which is used in such thermal recording and on which a high quality image can be recorded. See Japanese Unexamined Patent Publication Nos. 5(1993)-301447 and 5(1993)-24219. The heat-sensitive recording material comprises a color forming agent, a developing agent and a light absorbing dyestuff (photo-thermo conversion agent) provided on a support film and forms a color in a density according to the heat energy applied when the color forming agent is caused to react with the developing agent.

FIG. 7 schematically shows the structure of the heat-sensitive recording material. In FIG. 7, the heat-sensitive recording material 2 has a heat sensitive layer 14 formed by applying, to a support film 4, coating liquid containing therein emulsion obtained by dissolving micro-capsules 6 containing color forming agent 8, developing agent 10 and light absorbing dyestuff 12 in organic solvent which is insoluble or slightly soluble in water and then emulsifying and dispersing the solution. A protective layer 16 is formed over the heat sensitive layer 14.

When such a heat-sensitive recording material 2 is exposed to a laser beam modulated according to information to be recorded, the light absorbing dyestuff 12 converts light energy of the laser beam into heat energy and the permeability to substances of the micro-capsules 6 and the flowability of the developing agent 10 are increased according to the heat energy, whereby the developing agent 10 is brought into contact with the color forming agent 8 and reacts therewith and a color is developed in a predetermined density.

Such a heat-sensitive recording material is arranged not to form a color at a low heat energy level in order to ensure good shelf stability. That is, the micro-capsules 6 are not permeable to materials until heated to a predetermined temperature (glass transition temperature). Further the heat sensitive layer 14 containing the developing agent 10 is not flowable at normal temperatures. Accordingly in order to enable the heat-sensitive recording material 2 to form a color, a heat energy sufficient to fluidize the heat sensitive layer 14 and to heat the micro-capsules 6 to the glass transition temperature is necessary. This gives rise to a problem that the dynamic range of the laser beam is narrowed by an amount corresponding to the heat energy necessary to enable the recording material to form a color and it becomes difficult to obtain a high gradation image. Further load on the recording system required to cause the recording material to form a color becomes substantial.

The flowability of the heat sensitive layer 14 containing the developing agent 10 exhibits an Arrhenius type behavior, that is, the flowability sharply increases (viscosity decreases) with increase in temperature. FIG. 8 shows a result of measurement of temperature-dependence of the viscosity of the developing agent 10. In this case, the viscosity of the developing agent 10 decreases by more than one figure for increase in temperature of 40° C. from 80° C. to 120° C. Further it may be considered from FIG. 8 that the viscosity of the developing agent 10 decreases by at least two figures for increase in temperature from normal temperatures to 120° C.

However in the case of the heat-sensitive material 2, since the light absorbing dyestuff 12 which converts light energy of the laser beam into heat energy is uniformly distributed in the heat sensitive layer 14, the heat energy obtained from the light energy is dispersed to the parts other than the micro-capsules 6 more than necessary and the heat energy cannot be efficiently utilized.

Further the heat-sensitive recording material 2 may include three kinds of color forming agent 8 which respectively form yellow color, magenta color and cyan color in different heat energy ranges Ey, Em and Ec (Ey<Em<Ec). A multi-colored image is recorded on the heat-sensitive recording material 2 by first applying heat energy in the range Ey to the yellow color forming agent 8 by the laser beam by way of the light absorbing dyestuff 12, irradiating ultraviolet rays to the heat-sensitive recording material 2 to fix the yellow color thus formed, applying heat energy in the range Em to the magenta color forming agent 8 by the laser beam by way of the light absorbing dyestuff 12, irradiating ultraviolet rays to the heat-sensitive recording material 2 to fix the magenta color thus formed, applying heat energy in the range Ec to the cyan color forming agent 8 by the laser beam by way of the light absorbing dyestuff 12, and irradiating ultraviolet rays to the heat-sensitive recording material 2 to fix the cyan color thus formed.

In accordance with such a method, many steps are necessary to record a multi-colored image and at the same time, the heat-sensitive recording material 2 must be scanned three times for forming the respective colors, which can result in misregister of colors.

In order to overcome such problems, there has been proposed a technique in which yellow color forming agent, magenta color forming agent and cyan color forming agent are provided in different layers while light absorbents which absorb laser beams of different wavelengths are provided in the respective layers and the color forming agents are caused to simultaneously form the respective colors by use of three laser beams of different wavelengths, thereby making it feasible to record a multi-colored image in a short time. See Japanese Patent Publication No. 1(1989)-45439.

However this approach is disadvantageous in that since light absorbents which absorb laser beam and generate heat energy are distributed in all the layers, heat energy in one layer is apt to be transferred to the adjacent layer(s) and since the light absorbing characteristics of the respective light absorbents have certain wavelength widths, thermal interference occurs between the layers and bleeding of color is generated.

SUMMARY OF THE INVENTION

In view of the foregoing observations and description, the primary object of the present invention is to provide a method of and a device for thermal recording which can record a high gradation image with a high accuracy while making the best use of light energy of a recording light beam and ensuring a sufficient dynamic range of the recording light beam.

Another object of the present invention is to provide a method of and a device for thermal recording which can record a high quality multi-colored image without color bleeding in a short time.

In accordance with a first aspect of the present invention, there is provided a thermal recording method for recording information on a heat-sensitive recording material comprising a photo-thermo conversion agent which converts supplied light energy into heat energy, a developing agent and a color forming agent which encapsuled in micro-capsules whose permeability to materials increases with increase in said heat energy and forms a color by reaction with the developing agent wherein the improvement comprises the steps of localizing a photo-thermo conversion agent in and/or on micro-capsules, pre-heating the heat-sensitive recording material by supplying the heat-sensitive recording material with heat energy less than energy necessary to cause the heat-sensitive recording material to form a color and projecting onto the recording material with a light beam modulated according to the information to be recorded, thereby causing the heat-sensitive recording material to form a color in a predetermined density according to heat energy obtained from the light beam.

In accordance with a second aspect of the present invention, there is provided a thermal recording device for recording information on a heat-sensitive recording material comprising a photo-thermo conversion agent which converts supplied light energy into heat energy, a developing agent and a color forming agent which is encapsuled in micro-capsules whose permeability to materials increases with increase in said heat energy and forms a color by reaction with the developing agent wherein the improvement comprises a pre-heating means which pre-heats the heat-sensitive recording material in which a photo-thermo conversion agent is localized in and/or on the micro-capsules by supplying the heat-sensitive recording material with heat energy less than energy necessary to cause the heat-sensitive recording material to form a color and a light projecting means which projects onto the recording material a light beam modulated according to the information to be recorded, thereby causing the heat-sensitive recording material to form a color in a predetermined density according to heat energy obtained from the light beam.

In the method and the device described above, a heat-sensitive recording material in which the photo-thermo conversion agent is localized in the wall or near the wall of the micro-capsules in which the color forming agent is encapsuled is pre-heated to a temperature just below the color forming temperature so that the flowability of the developing agent is sufficiently increased and the micro-capsules are heated to a temperature just below the temperature at which the micro-capsules become permeable to material. Then a light beam modulated according to the information to be recorded is projected onto the heat-sensitive recording material thus pre-heated. Light energy of the light beam is converted into heat energy by the photo-thermo conversion agent. Since the photo-thermo conversion agent is localized in and/or on the micro-capsules, the heat energy efficiently increases the permeability to materials of the micro-capsules, whereby a predetermined amount of the developing agent enters the micro-capsules and reacts with the color forming agent, and the information can be recorded with a minimum light energy.

In accordance with a third aspect of the present invention, there is provided a thermal recording method for recording information on a heat-sensitive recording material comprising a photo-thermo conversion agent which converts supplied light energy into heat energy, a developing agent and a color forming agent which is encapsuled in micro-capsules whose permeability to materials increases with increase in said heat energy and forms a color by reaction with the developing agent wherein the improvement comprises the steps of encapsulating different color forming agents separately in micro-capsules, localizing photo-thermo conversion agents which convert light energy of particular wavelengths separately in and/or on the micro-capsules containing therein the color forming agents corresponding to the wavelengths, pre-heating the heat-sensitive recording material by supplying the heat-sensitive recording material with heat energy less than energy necessary to cause the heat-sensitive recording material to form a color and projecting onto the recording material a plurality of light beams of said particular wavelengths modulated according to the information to be recorded, thereby causing the heat-sensitive recording material to form predetermined colors in predetermined densities according to heat energy obtained from the light beams.

In accordance with a fourth aspect of the present invention, there is provided a thermal recording device for recording information on a heat-sensitive recording material comprising a photo-thermo conversion agent which converts supplied light energy into heat energy, a developing agent and a color forming agent which is encapsuled in micro-capsules whose permeability to materials increases with increase in said heat energy and forms a color by reaction with the developing agent wherein the improvement comprises a pre-heating means which pre-heats the heat-sensitive recording material in which different color forming agents are separately encapsulated in micro-capsules, and photo-thermo conversion agents which convert light energy of particular wavelengths are separately localized in and/or on the micro-capsules containing therein the color forming agents corresponding to the wavelengths by supplying the heat-sensitive recording material with heat energy less than energy necessary to cause the heat-sensitive recording material to form a color and a light projecting means which projects onto the recording material a plurality of light beams of said particular wavelengths modulated according to the information to be recorded, thereby causing the heat-sensitive recording material to form predetermined colors in predetermined densities according to heat energy obtained from the light beams.

In the method and the device in accordance with the third and fourth aspects of the present invention, a heat-sensitive recording material in which different color forming agents are separately encapsulated in micro-capsules, and photo-thermo conversion agents which convert light energy of particular wavelengths are separately localized in the wall or near the wall of the micro-capsules containing therein the color forming agents corresponding to the wavelengths is pre-heated to a temperature just below the color forming temperature so that the flowability of the developing agent is sufficiently increased and the micro-capsules are heated to a temperature just below the temperature at which the micro-capsules become permeable to material. Then a plurality of light beams separately modulated according to the information to be recorded are projected onto the heat-sensitive recording material thus pre-heated. Light energy of each light beam is converted into heat energy by the photo-thermo conversion agent corresponding to the wavelength of the light beam. Since the photo-thermo conversion agents are localized in and/or on the micro-capsules for the respective colors, the heat energy efficiently increases the permeability to materials of the micro-capsules, whereby the developing agents enter the micro-capsules for the respective colors in a predetermined amounts and react with the color forming agents, and the information can be recorded in a multi-colored image with a minimum light energy in a shot time. Further since the photo-thermo conversion agents are separately localized in and/or on the micro-capsules, each of the photo-thermo conversion agents hardly contributes to making the micro-capsules for other colors permeable to materials, whereby generation of color bleeding is prevented.

DESCRIPTION OF THE PREFERRED EMBODIMENT

Figure 1:
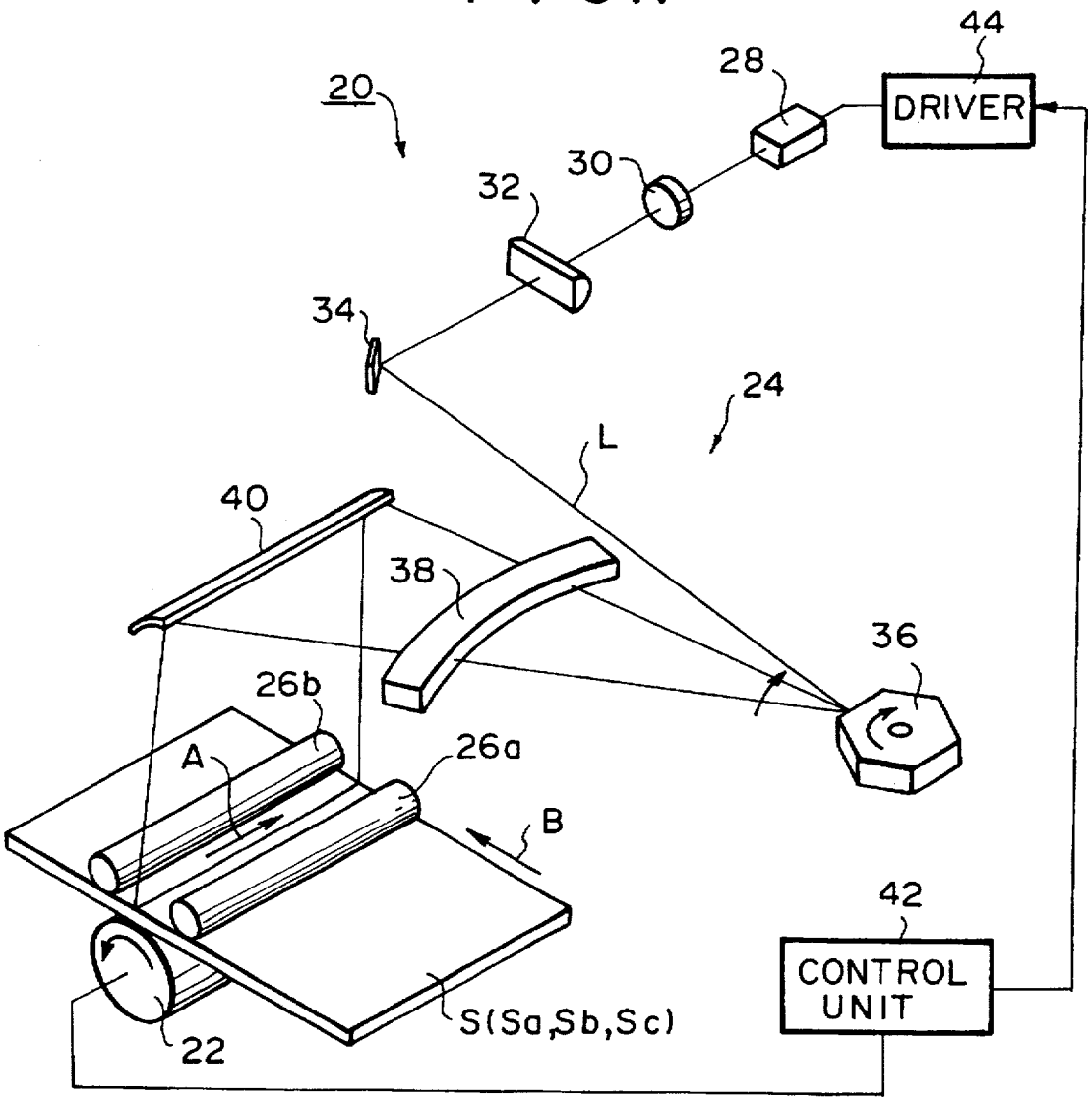
FIG. 1 is a schematic perspective view of a thermal recording device in accordance with a first embodiment of the present invention.

In FIG. 1, a thermal recording device 20 in accordance with a first embodiment of the present invention is for recording an image on a heat-sensitive recording material S by scanning the heat-sensitive recording material S with a laser beam L in the direction of arrow A (main scanning) while conveying the heat-sensitive recording material S in the direction of arrow B (sub-scanning). The thermal recording device 20 includes a heat roll 22 for pre-heating the heat-sensitive recording material S and a laser scanning optical system 24 for scanning the heat-sensitive recording material S with the laser beam L.

The heat roll 22 pre-heats the heat-sensitive recording material S to a predetermined temperature just below the color forming temperature and conveys the heat-sensitive recording material S in the direction of arrow B associated with a pair of nip rolls 26*a* and 26*b*. The laser scanning optical system 24 comprises a laser diode 28 which outputs a laser beam L, a collimator lens 30 which collimates the laser beam L, a cylindrical lens 32, a reflecting mirror 34, a polygonal mirror 36 which deflects the laser beam L, an fθ lens 38, and a cylindrical mirror 40 which is associated with the cylindrical lens 32 to compensate for surface tilt in deflecting surfaces of the polygonal mirror 36. The laser beam L impinges upon the heat-sensitive recording material S between the nip rolls 26*a* and 26*b*. A control unit 42 controls the heat roll 22 to control the pre-heating temperature of the heat-sensitive recording material S. The laser diode 28 is controlled by the control unit 42 byway of a driver 44.

Figure 2:
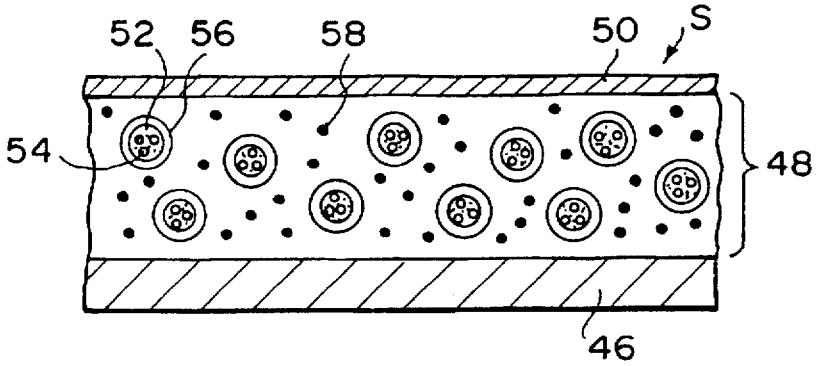
FIG. 2 is a view showing an example of the heat-sensitive recording material which can be employed in the thermal recording device shown in FIG. 1.

As shown in FIG. 2, the heat-sensitive recording material S comprises a heat-sensitive layer 48 which forms a color in a predetermined density by heat energy obtained from the laser beam L and is formed on a support film 46 and a protective layer 50 is formed on the heat-sensitive layer 48.

The heat-sensitive layer 48 is formed by applying, to the support film 46, coating liquid containing therein emulsion obtained by dissolving micro-capsules 56 encapsulating therein a color forming agent 52 and a light absorbing dyestuff (photo-thermo conversion agent) 54 and a developing agent 58 in organic solvent which is insoluble or slightly soluble in water and then emulsifying and dispersing the solution. See Japanese Unexamined Patent Publication Nos. 4(1992)-331186 and 4(1992)-307292.

The color forming agent 52 is a material which generates a color forming reaction upon contact with other materials. As the color forming agent 52, a combination of a photolyzing diazo compound and a coupler or a combination of a precursor of an electron donating dyestuff and an acidic material is preferred.

The photolyzing diazo compound is a compound which reacts with a developing agent 58 called a coupling component (to be described later) to be colored in a desired hue and degrades when exposed to light of a particular wavelength to be disabled from being colored upon subsequent contact with a coupling component. The hue in this coloring system is mainly governed by a diazo dyestuff generated by reaction of the diazo compound and the coupling component. Accordingly as is well known in the art, the hue can be easily changed by changing the chemical structure of the diazo compound or the coupling component, and substantially any hue can be obtained depending on the combination of the diazo compound and the coupling component.

In this embodiment, the term "photolyzing diazo compound" mainly means aromatic diazo components, and more particularly aromatic diazonium salts, diazo sulfonate compounds, diazo amino compounds and the like. The diazonium salts are represents by a general formula $ArN_2^+X^-$ wherein Ar represents an aromatic compound not substituted or partly substituted, $N_2^+$ represents a diazonium group and $X^-$ represents an acidic anion.

It is generally said that the photolyzing wavelength of the diazonium salt is a peak absorption wavelength. Further it has been known that the peak absorption wavelength of the diazonium salt varies from about 200 nm to about 700 nm depending on the chemical structure thereof. See "Photolysis and Chemical Structure of Photosensitive Diazonium Salts" by Takahiro Tsunoda and Tsuguo Yamaoka [Japanese Photographic Academy Journal, 29(4) pp. 197~205 (1965)]. That is, when the diazonium salt is used as a photolyzing compound, it degrades when exposed to light of a particular wavelength according to its chemical structure and by changing the chemical structure of the diazonium salt, hue of dyestuff obtained by coupling reaction with a given coupling component can be changed.

As a light source for photolysis, various light sources emitting light of a desired wavelength can be employed. For example, various fluorescent tubes, xenon laps, xenon flash lamps, mercury vapor lamps with various vapor pressure, photographic stroboscope and the like may be employed.

There have been known various diazo sulfonate compounds which are obtained by treating diazonium salts with nitrite. Diazo amino compounds are obtained by coupling of diazo groups with dicyandiamide, sarcosine, methyltaurine, N-ethylantranilic acid-5-sulfonic acid, monoethanolamine, diethanolamine, guanidine or the like.

As the coupling component (developing agent 58) which generates dyestuff by coupling reaction with the diazo compound (diazonium salt), for instance, 2-hydroxy-3-naphthoic anilide and resorcin can be employed.

Further by use of two or more coupling components, an image with a desired color tone can be obtained. Since the coupling reaction of the diazo compounds with the coupling components is apt to occur in a basic atmosphere, a basic material may be added to the layer.

As the basic material, those which are insoluble or slightly soluble in water or those which generate alkali when heated may be employed. For example, may be employed nitrogen-containing compounds such as organic or inorganic ammonium salts, organic amines, amides, ureas, thioureas, their derivatives, thiazoles, pyrroles, pyrimidines, piperazines, guanidines, indoles, imidazoles, imidalines, triazoles, morpholines, piperidines, adimines, formazines, pyridines and the like. Two or more of these basic materials may be used together.

As the precursor of an electron donating dyestuff, is employed a compound which is generally substantially colorless, is colored by donating electrons or accepting protons of acid or the like and has a partial framework of lactone, lactam, sultone, spiro-pyran, ester, amide or the like and in which ring opening or cleavage of the partial framework occurs upon contact with a developing agent, though need not be limited to such a compound. For example, crystal violet lactone, benzoyl leuco methylene blue, malachite green lactone, rhodamine B lactam, 1,3,3-trimethyl-6'-ethyl-8'-butoxyindolinonebenzospiropyran and the like can be used.

As the developing agent 58 for these color forming agents, acidic compounds such as phenol compounds, organic acids, metal salts of organic acids, oxybenzoate esters or the like are employed.

As the light absorbing dyestuff 54, those having a low light absorption coefficient to visible light and an especially high light absorption coefficient to wavelengths in the infrared region are preferred. For example, cyanine dyestuffs, phthalocyanine dyestuffs, pyrylium or thiopyrylium dyestuffs, azulenium dyestuffs, squarylium dyestuffs, metal complex dyestuffs such as of Ni or Cr, naphthoquinone or anthraquinone dyestuffs, indophenol dyestuffs, indoanyline dyestuffs, triphenylmethane dyestuffs, triarylmethane dyestuffs, aminium or diimmonium dyestuffs and nitroso compounds can be used.

Among these compounds, those having a high absorption coefficient to light in near infrared region having wavelengths of 700 to 900 nm are especially preferred in view of the fact that semiconductor lasers oscillating near infrared rays have been put into practice.

The micro-capsule 56 has a wall whose permeability to materials increases with increase in heat energy supplied and can be produced, for instance, in the following manner.

That is, the micro-capsules 56 employed in this embodiment may be produced by any of interfacial polymerization, internal polymerization and external polymerization. However, it is preferred that the micro-capsules 56 be produced by emulsifying cores containing therein the color forming agent 52 and the light absorbing dyestuff 54 in aqueous solution of water-soluble polymer and then forming polymer walls around oil droplets.

The reactant for forming the polymer walls is added to the inside and/or outside of the oil droplets. The polymer walls may be of, for instance, polyurethane, polyurea, polyamide, polyester, polycarbonate, urea-formaldehyde resin, melamine resin, polystyrene, styrenmethacrylate copolymer, styrene-acrylate copolymer or the like. Polyurethane, polyurea, polyamide, polyester and polycarbonate are preferred and polyurethane and polyurea are especially preferred. Two or more of these polymers may be used together.

Said water-soluble polymer may be gelatin, polyvinylpyrrolidone, polyvinyl alcohol or the like. For example, when polyurea is used as the material of the capsule wall, the capsule wall can be easily formed by reacting polyisocyanate such as diisocyanate, triisocyanate, tetraisocyanate, polyisocyanate prepolymer or the like with polyamine such as diamine, triamine and tetraamine, or prepolymer containing therein two or more amino groups, or piperazine and derivatives thereof, or polyols by interfacial polymerization in aqueous solvent.

Composite capsule wall of polyurea and polyamide or that of polyurethane and polyamide can be formed by using polyisocyanate and acid chloride or polyamine and polyol and heating emulsion medium (reaction liquid) after adjusting pH of the emulsion medium.

Figure 3:
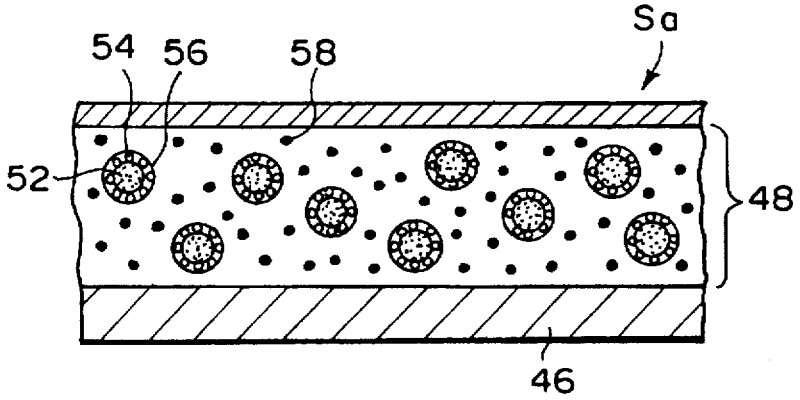
FIG. 3 is a view showing another example of the heat-sensitive recording material which can be employed in the thermal recording device shown in FIG. 1.
Figure 4:
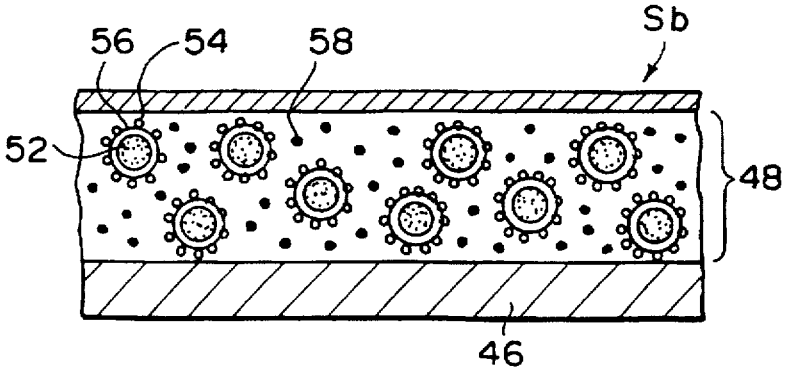
FIG. 4 is a view showing still another example of the heat-sensitive recording material which can be employed in the thermal recording device shown in FIG. 1.
Figure 5:
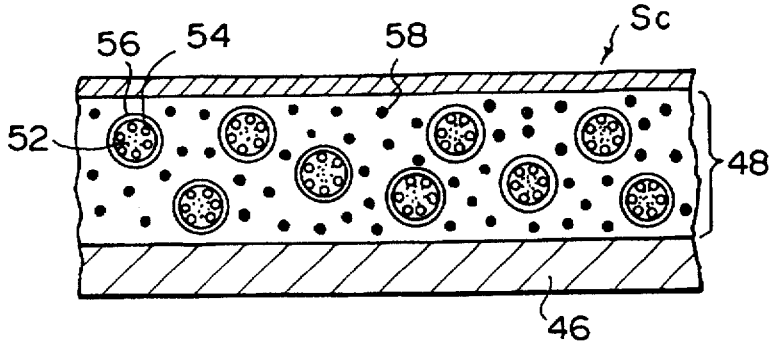
FIG. 5 is a view showing still another example of the heat-sensitive recording material which can be employed in the thermal recording device shown in FIG. 1.

Heat-sensitive recording materials Sa, Sb and Sc respectively shown in FIGS. 3 to 5 can be employed as the heat-sensitive recording material in this embodiment. In the heat-sensitive recording material Sa shown in FIG. 3, the light absorbing dyestuff 54 is embedded in the walls of the micro-capsules 56. In the heat-sensitive recording material Sb shown in FIG. 4, the light absorbing dyestuff 54 is on the outer surface of the walls of the micro-capsules 56. In the heat-sensitive recording material Sc shown in FIG. 5, the light absorbing dyestuff 54 is on the inner surface of the walls of the micro-capsules 56. When the sensitivity of the heat-sensitive recording material is to be increased by increasing absorption of energy of the laser beam L, the light absorbing dyestuff 54 may be positioned on the inner and outer surfaces of the capsule walls and in the capsule walls.

When the light absorbing dyestuff 54 is to be on the outer surface of the micro-capsules 56 (FIG. 4), the light absorbing dyestuff 54 should preferably be selected from those which absorb less light having wavelengths within visible region and have a high absorptivity to light having wavelengths within infrared region in view of preventing the heat-sensitive recording material Sb from being colored. When the light absorbing dyestuff 54 is to be embedded in the walls of the micro-capsules 56 (FIG. 3), it is preferred that a light absorbing dyestuff having an active group which reacts with the material for forming the walls of the micro-capsules when forming the walls be used.

As the active group, an isocyanate group, a hydroxyl group, a mercapto group, an amino group and the like can be employed with an isocyanate group and a hydroxyl group preferred. A solid sensitizer may be added to cause the walls of the micro-capsules 56 to swell upon heating by the laser beam L.

As the solid sensitizer, those which are plasticizer of the polymer used as the material of the walls of the micro-capsules 56 and have a melting point not lower than 50° C., preferably not higher than 120° C., and are solid at normal temperatures. When the walls are of polyurea or polyurethane, hydroxyl compounds, carbamic acid ester compounds, aromatic alkoxy compounds, organic sulfonamide compounds, fatty amide compounds, arylamide compounds and the like may be preferably used.

The operation of the thermal recording device 20 will be described, hereinbelow.

Figure 6:
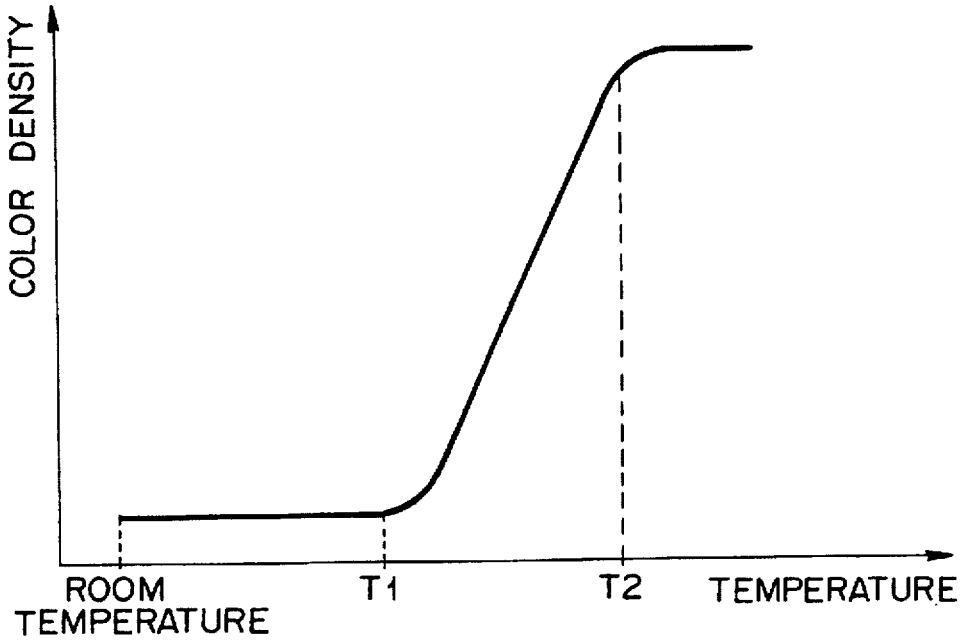
FIG. 6 is a view for illustrating the color developing characteristics of the heat-sensitive recording material.
Figure 7:
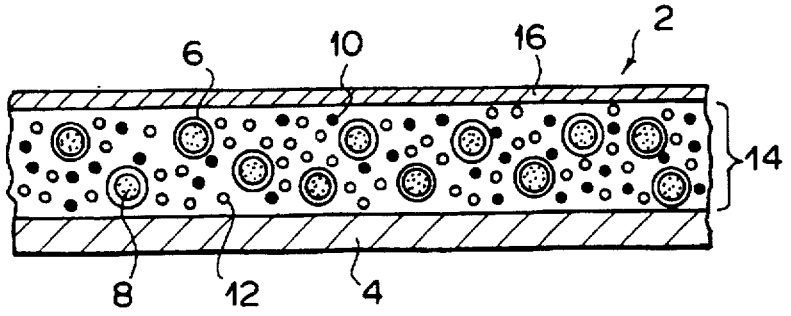
FIG. 7 is a view showing the heat-sensitive recording material in accordance with a prior art.

The control unit 42 pre-heats the heat-sensitive recording material S nipped between the heat roll 22 and the nip rolls 26*a* and 26*b* while conveying the heat-sensitive recording material S in the direction of arrow B (sub-scanning). That is, the heat roll 22 is brought into abutment against the heat-sensitive recording material S and heats the material S to a temperature just below a color developing temperature. The curve a in FIG. 6 shows the relation between the temperature of the heat-sensitive recording material S and the density of color developed. The heat-sensitive recording material S is pre-heated to a temperature T1. The temperature T1 is set to a temperature lower than a glass transition temperature at which the micro-capsules 56 in the heat sensitive layer 48 become permeable to materials. In this state, the developing agent 58 in the heat sensitive layer 48 exhibits an Arrhenius type behavior and is rapidly fluidized by the heat energy applied from the heat roll 22.

In the state described above, the control unit 42 drives the laser diode 28 byway of the driver 44. The laser diode 28 outputs a laser beam L modulated according to the gradation of an image to be recorded on the heat-sensitive recording material S. The laser beam L is collimated by the collimator lens 30 and impinges upon the polygonal mirror 36 through the cylindrical lens 32 and the reflecting mirror 34. The polygonal mirror 36 is rotating at a high speed and the laser beam L is deflected by the polygonal mirror 36 to impinge upon the heat-sensitive recording material S through the fθ lens 38 and the cylindrical mirror 34, thereby scanning the heat-sensitive recording material S in the direction of arrow A (main scanning).

The light energy of the laser beam L is converted into heat energy by the light absorbing dyestuff 54 localized in the walls or near the walls of the micro-capsules 56 in the heat sensitive layer 48. The micro-capsules 56 are heated by the heat energy and when the temperature of the micro-capsules 56 exceeds the glass transition temperature, the micro-capsules 56 become permeable. As the temperature of the micro-capsules 56 become higher, the micro-capsules 56 become more permeable and the developing agent 58 which has been fluidized by the heat roll 22 enters the micro-capsules 56 in a predetermined amount and contacts with the color forming agent 52, whereby color forming reaction occurs and a gradation image is formed. The gradation image can be fixed by exposing the heat-sensitive recording material S to light of a particular wavelength, as required.

Since the light absorbing dyestuff 54 which supplies heat energy to the micro-capsules 56 is localized in or on the micro-capsules 56 (in the capsule in the case of the heat-sensitive recording material S shown in FIG. 2, in the walls of the capsules in the case of the heat-sensitive recording material Sa shown in FIG. 3, on the outer surface of the walls in the case of the heat-sensitive recording material Sb shown in FIG. 4 and on the inner surface of the walls in the case of the heat-sensitive recording material Sc shown in FIG. 5), the light absorbing dyestuff 54 effectively heats only the micro-capsules 56 without heating the developing agent 58 or the like more than necessary. Accordingly, the light energy from the laser beam L is very efficiently supplied to the micro-capsules 56 and contributes to development of colors.

Further since the heat-sensitive recording material S has been pre-heated to the temperature T1 (FIG. 6) by the heat roll 22, the laser diode 28 need not be controlled in a wide temperature range between the room temperature of the place where the thermal recording device 20 is installed and the temperature T2 shown in FIG. 6. That is, the laser diode 28 is controlled in the temperature range between the temperatures T1 and T2 and a high gradation image can be recorded with a high accuracy. Further since the laser diode 28 need not output high power, the thermal recording device 20 can be simplified in structure and can be manufactured at low cost.

A second embodiment of the present invention will be described, hereinbelow. In the second embodiment, the elements analogous to those in the first embodiment will be denoted by the same reference numerals and will not be described in detail.

Figure 9:
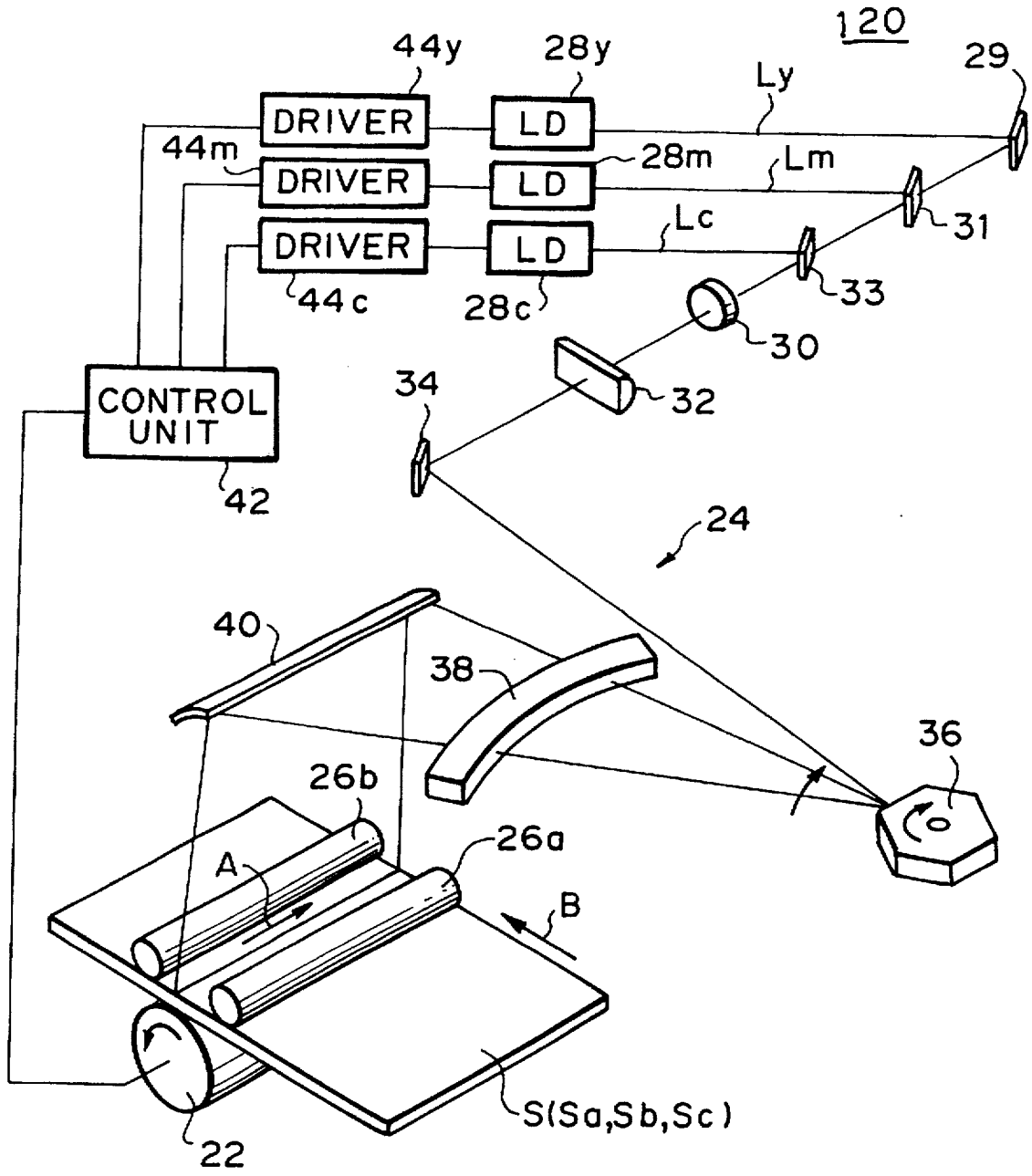
FIG. 9 is a schematic perspective view of a thermal recording device in accordance with a second embodiment of the present invention.

In FIG. 9, a thermal recording device 120 in accordance with a second embodiment of the present invention is for recording an image on a heat-sensitive recording material S by simultaneously scanning the heat-sensitive recording material S with three laser beams Ly, Lm and Lc having different wavelengths in the direction of arrow A (main scanning) while conveying the heat-sensitive recording material S in the direction of arrow B (sub-scanning). The thermal recording device 120 includes a heat roll 22 for pre-heating the heat-sensitive recording material S and a laser scanning optical system 24 for scanning the heat-sensitive recording material S with the laser beams Ly, Lm and Lc. The wavelengths of the respective laser beams Ly, Lm and Lc correspond respectively to absorption wavelengths of light absorbing dyestuffs 54*y*, 54*m* and 54*c* in the heat-sensitive recording material S to be described later.

The heat roll 22 pre-heats the heat-sensitive recording material S to a predetermined temperature just below the color forming temperature and conveys the heat-sensitive recording material S in the direction of arrow B associated with a pair of nip rolls 26*a* and 26*b*. The laser scanning optical system 24 comprises three laser diodes 28*y*, 28*m* and 28*c* which outputs three laser beams Ly, Lm and Lc of different wavelengths, a reflecting mirror 29 which reflects the laser beam Ly, a dichroic mirror 31 which reflects the laser beam Lm and transmits the laser beam Ly, a dichroic mirror 33 which reflects the laser beam Lc and transmits the laser beams Ly and Lm, a collimator lens 30 which collimates the laser beams Ly, Lm and Lc, a cylindrical lens 32, a reflecting mirror 34, a polygonal mirror 36 which deflects the laser beams Ly, Lm and Lc, an fθ lens 38, and a cylindrical mirror 40 which is associated with the cylindrical lens 32 to compensate for surface tilt in deflecting surfaces of the polygonal mirror 36. The laser beams Ly, Lm and Lc simultaneously impinge upon the heat-sensitive recording material S between the nip rolls 26*a* and 26*b*. A control unit 42 controls the heat roll 22 to control the pre-heating temperature of the heat-sensitive recording material S. The laser diodes 28*y*, 28*m* and 28*c* are controlled by the control unit 42 by way of drivers 44*y*, 44*m* and 44*c*.

Figure 10:
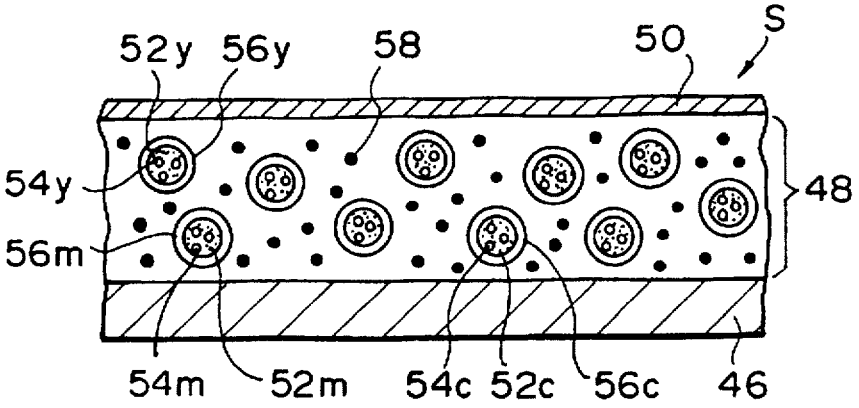
FIG. 10 is a view showing an example of the heat-sensitive recording material which can be employed in the thermal recording device shown in FIG. 9.
Figure 11:
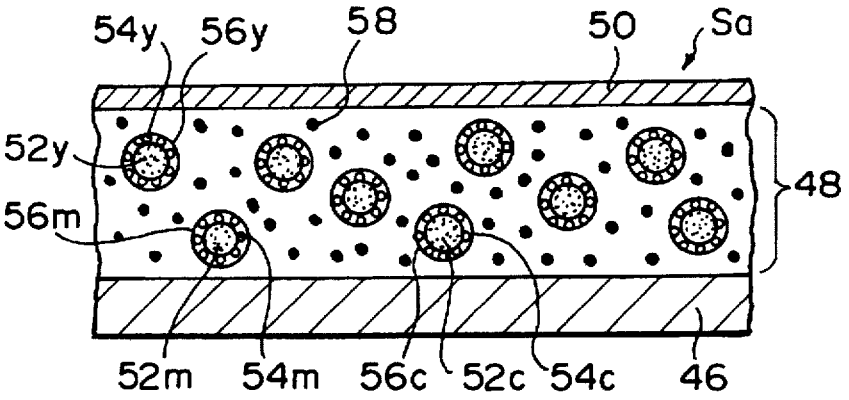
FIG. 11 is a view showing another example of the heat-sensitive recording material which can be employed in the thermal recording device shown in FIG. 9.
Figure 12:
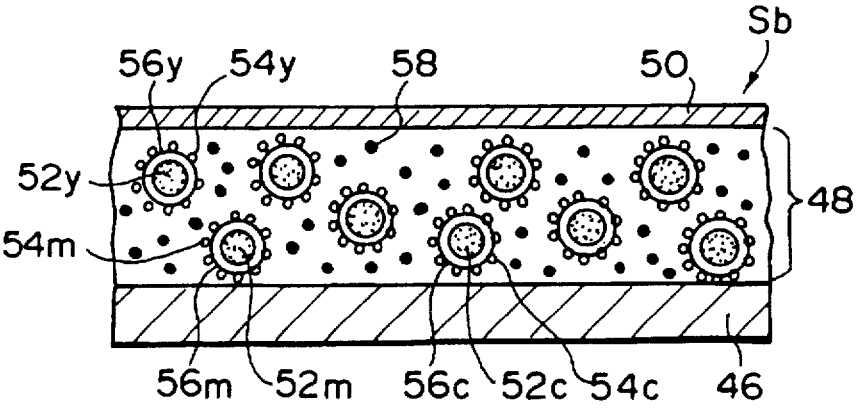
FIG. 12 is a view showing still another example of the heat-sensitive recording material which can be employed in the thermal recording device shown in FIG. 9.
Figure 13:
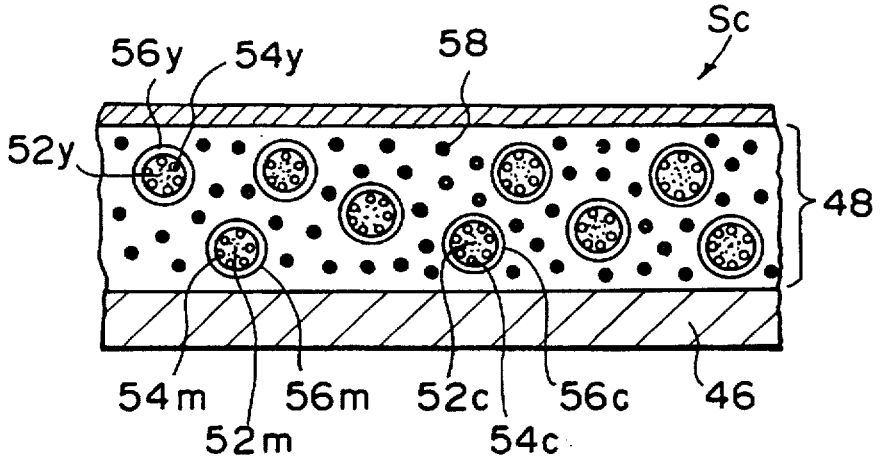
FIG. 13 is a view showing still another example of the heat-sensitive recording material which can be employed in the thermal recording device shown in FIG. 9.

As shown in FIG. 10, the heat-sensitive recording material S employed in this embodiment comprises a heat-sensitive layer 48 which is formed on a support film 46 and forms a color in a predetermined density by heat energy obtained from the laser beams Ly, Lm and Lc and a protective layer 50 is formed on the heat-sensitive layer 48.

The heat-sensitive layer 48 is formed by applying, to the support film 46, coating liquid containing therein emulsion obtained by dissolving micro-capsules 56*y* encapsulating therein a color forming agent 52*y* which forms yellow color and a light absorbing dyestuff (photo-thermo conversion agent) 54*y* which converts only light energy of the laser beam Ly into heat energy, micro-capsules 56*m* encapsulating therein a color forming agent 52*m* which forms magenta color and a light absorbing dyestuff (photo-thermo conversion agent) 54*m* which converts only light energy of the laser beam Lm into heat energy, micro-capsules 56*c* encapsulating therein a color forming agent 52*c* which forms cyan color and a light absorbing dyestuff (photo-thermo conversion agent) 54*c* which converts only light energy of the laser beam Lc into heat energy, and a developing agent 58 in organic solvent which is insoluble or slightly soluble in water and then emulsifying and dispersing the solution. As for the micro-capsules encapsulating the color forming agent and the light absorbing dyestuff, see Japanese Unexamined Patent Publication Nos. 4(1992)-331186 and 4(1992)-307292.

The color forming agents 52*y*, 52*m* and 52*c* are materials which generate a color forming reaction upon contact with other materials. As the color forming agents 52*y*, 52*m* and 52*c*, a combination of a photolyzing diazo compound and a coupler or a combination of a precursor of an electron donating dyestuff and an acidic material is preferred.

The photolyzing diazo compound, the coupler and the precursor of an electron donating dyestuff have been described in conjunction with the first embodiment.

As the light absorbing dyestuffs 54*y*, 54*m* and 54*c*, those having a low light absorption coefficient to visible light and an especially high light absorption coefficient to wavelengths in the infrared region are preferred.

Such light absorbing dyestuffs include, for instance, inorganic compounds e.g., metal oxides such as aluminum oxide; metal hydroxides such as aluminum hydroxide and magnesium hydroxide; silicates such as olivine, garnet, pyroxene, amphibole, mica, feldspar and clay mineral; silicate compounds such as zinc silicate, magnesium silicate, calcium silicate and barium silicate; phosphates such as zinc phosphate; nitrides such as trisilicon tetranitride and boron nitride; sulfate compounds such as barium sulfate, calcium sulfate and strontium sulfate; carbonate compounds such as calcium carbonate, barium carbonate, magnesium carbonate and zinc carbonate; and nitrates such as potassium nitrate, and organic compounds e.g., triphenylphosferrite, 2-ethylhexyldiphenylphosferrite, furfurylacetate, bis(1-thio-2-phenolate)nickel-tetrabutylammonium, 1,1'-diethyl-4,4'-quinocarbocyaniniodide, and 1,1'-diethyl-6,6'dichloro-4,4'-quinotricarbocyaniniodide.

These dyestuffs are divided into three types according their absorption wavelengths and are used as light absorbing dyestuffs 54*y*, 54*m* and 54*c*, respectively. The absorption wavelengths λy, λm and λc are set according to the wavelengths of the infrared laser beams Ly, Lm and Lc emitted from the laser diodes 28*y*, 28*m* and 28*c* available at present.

The micro-capsules 56*y*, 56*m* and 56*c* have a wall whose permeability to materials increases with increase in heat energy supplied and can be produced, for instance, in the following manner.

That is, the micro-capsules 56*y*, 56*m* and 56*c* employed in this embodiment may be produced by any of interfacial polymerization, internal polymerization and external polymerization. However, it is preferred that the micro-capsules 56*y*, 56*m* and 56*c* be produced by emulsifying cores containing therein the color forming agent 52*y*, 52*m* and 52*c* and the light absorbing dyestuffs 54*y*, 54*m* and 54*c* in aqueous solution of water-soluble polymer and then forming polymer walls around oil droplets.

The reactant for forming the polymer walls is added to the inside and/or outside of the oil droplets. The polymer walls may be of, for instance, polyurethane, polyurea, polyamide, polyester, polycarbonate, urea-formaldehyde resin, melamine resin, polystyrene, styren-methacrylate copolymer, styrene-acrylate copolymer or the like. Polyurethane, polyurea, polyamide, polyester and polycarbonate are preferred and polyurethane and polyurea are especially preferred. Two or more of these polymers may be used together.

Said water-soluble polymer may be gelatin, polyvinylpyrrolidone, polyvinyl alcohol or the like. For example, when polyurea is used as the material of the capsule wall, the capsule wall can be easily formed by reacting polyisocyanate such as diisocyanate, triisocyanate, tetraisocyanate, polyisocyanate prepolymer or the like with polyamine such as diamine, triamine and tetraamine, or prepolymer containing therein two or more amino groups, or piperazine and derivatives thereof, or polyols by interfacial polymerization in aqueous solvent.

Composite capsule wall of polyurea and polyamide or that of polyurethane and polyamide can be formed by using polyisocyanate and acid chloride or polyamine and polyol and heating emulsion medium (reaction liquid) after adjusting pH of the emulsion medium.

Heat-sensitive recording materials Sa, Sb, Sc and Sd respectively shown in FIGS. 11 to 14 can be employed as the heat-sensitive recording material in this embodiment. In the heat-sensitive recording material Sa shown in FIG. 11, the light absorbing dyestuffs 54*y*, 54*m* and 54*c* are embedded in the walls of the respective micro-capsules 56*y*, 56*m* and 56*c*. In the heat-sensitive recording material Sb shown in FIG. 12, the light absorbing dyestuffs 54*y*, 54*m* and 54*c* are on the outer surface of the walls of the respective micro-capsules 56*y*, 56*m* and 56*c*. In the heat-sensitive recording material Sc shown in FIG. 13, the light absorbing dyestuffs 54*y*, 54*m* and 54*c* are on the inner surface of the walls of the respective micro-capsules 56*y*, 56*m* and 56*c*.

When the light absorbing dyestuffs 54*y*, 54*m* and 54*c* are to be on the outer surface of the micro-capsules 56*y*, 56*m* and 56*c* (FIG. 12), the light absorbing dyestuffs 54*y*, 54*m* and 54*c* should preferably be selected from those which absorb less light having wavelengths within visible region and have a high absorptivity to light having wavelengths within infrared region in view of preventing the heat-sensitive recording material Sb from being colored. When the light absorbing dyestuffs 54*y*, 54*m* and 54*c* are to be embedded in the walls of the micro-capsules 56y, 56m and 56c (FIG. 11), it is preferred that the light absorbing dyestuffs 54y, 54m and 54c have an active group which reacts with the material for forming the walls of the micro-capsules 56y, 56m and 56c when forming the walls.

As the active group, an isocyanate group, a hydroxyl group, a mercapto group, an amino group and the like can be employed with an isocyanate group and a hydroxyl group preferred. A solid sensitizer may be added to cause the walls of the micro-capsules 56y, 56m and 56c to swell upon heating by the laser beams Ly, Lm and Lc.

As the solid sensitizer, those which are plasticizer of the polymer used as the material of the walls of the micro-capsules 56 and have a melting point not lower than 50° C., preferably not higher than 120° C., and are solid at normal temperatures. When the walls are of polyurea or polyurethane, hydroxyl compounds, carbamic acid ester compounds, aromatic alkoxy compounds, organic sulfonamide compounds, fatty amide compounds, arylamide compounds and the like may be preferably used.

Figure 14:
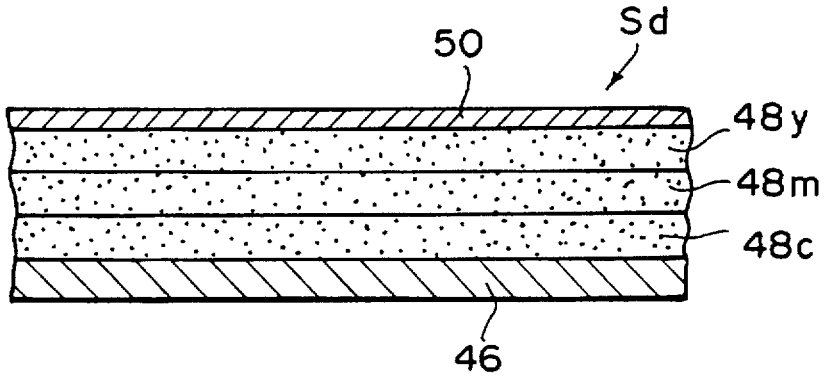
FIG. 14 is a view showing still another example of the heat-sensitive recording material which can be employed in the thermal recording device shown in FIG. 9.

In the heat-sensitive recording material Sc shown in FIG. 14, the heat sensitive layer 48 comprises three layers 48y, 48m and 48c respectively containing therein micro-capsules 56y, 56m and 56c. In this modification the micro-capsules 56y, 56m and 56c may be in the form of any one of those shown in FIGS. 10 to 14. Since generally the shorter the wavelength, the more the light is apt to be scattered, it is preferred that the heat sensitive layer to be recorded by a shorter wavelength laser beam be disposed upper (nearer to the cylindrical mirror 40).

The operation of the thermal recording device 120 of the second embodiment will be described, hereinbelow.

The control unit 42 pre-heats the heat-sensitive recording material S nipped between the heat roll 22 and the nip rolls 26a and 26b while conveying the heat-sensitive recording material S in the direction of arrow B (sub-scanning). That is, the heat roll 22 is brought into abutment against the heat-sensitive recording material S and heats the material S to a temperature just below a color developing temperature.

Figure 8:
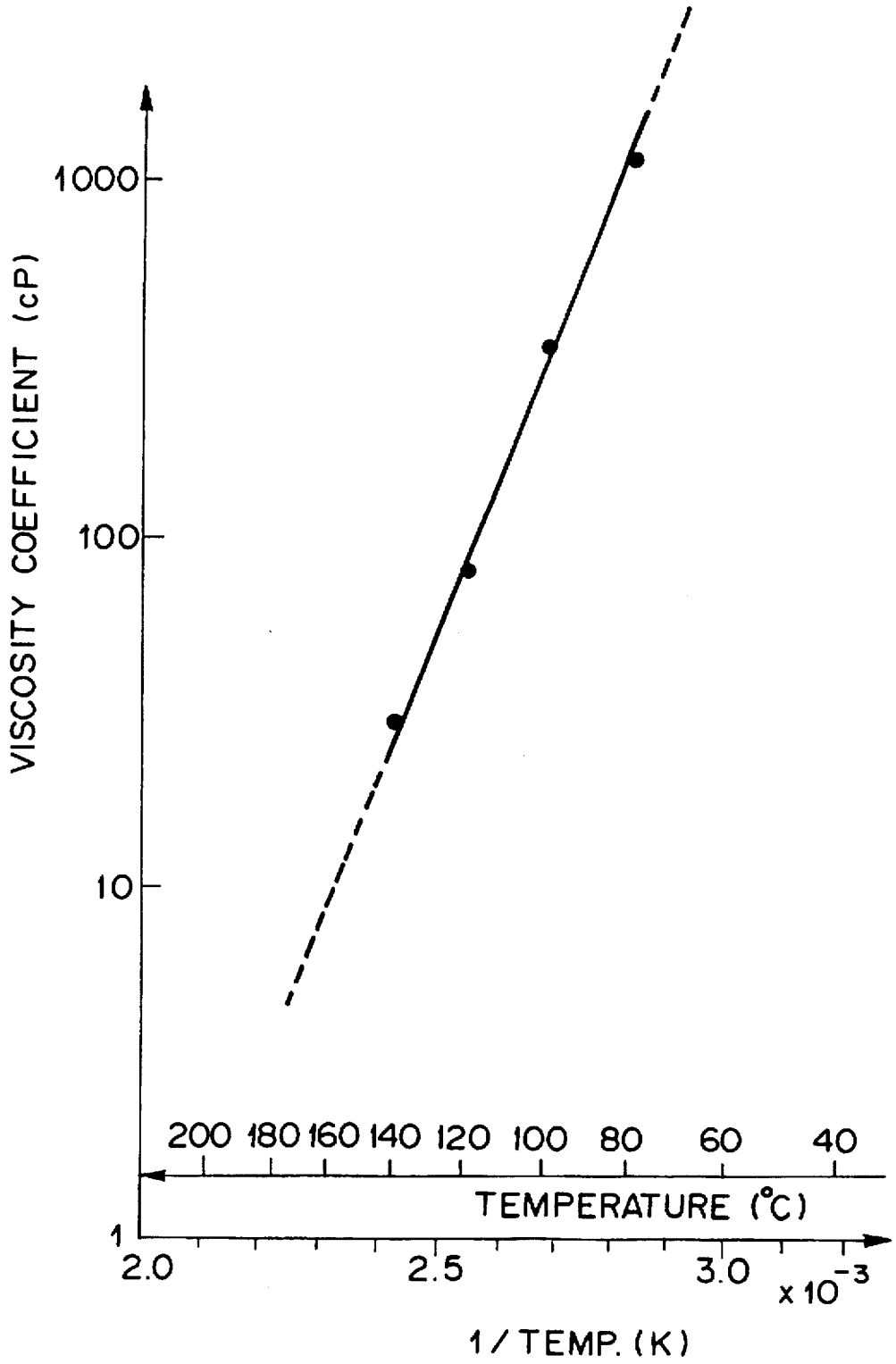
FIG. 8 is a view showing temperature-dependence of the viscosity of the developing agent.

As in the first embodiment, the heat-sensitive recording material S is pre-heated to a temperature T1 (FIG. 6). The temperature T1 is set to a temperature lower than a glass transition temperature at which the micro-capsules 56y, 56m and 56c in the heat sensitive layer 48 become permeable to materials. In this state, the developing agent 58 in the heat sensitive layer 48 exhibits an Arrhenius type behavior (FIG. 8) and is rapidly fluidized by the heat energy applied from the heat roll 22.

In the state described above, the control unit 42 drives the laser diodes 44y, 44m and 44c by way of the drivers 44y, 44m and 44c. The laser diodes 28y, 28m and 28c output laser beams Ly, Lm and Lc respectively modulated according to the gradation of the colors of an image to be recorded on the heat-sensitive recording material S. The laser beam Ly is reflected by the reflecting mirror 29 and enters the collimator lens 30 through the dichroic mirrors 31 and 33. The laser beam Lm is reflected by the dichroic mirror 31 and enters the collimator lens 30 through the dichroic mirror 33. The laser beam Lc is reflected by the dichroic mirror 33 and enters the collimator lens 30. The laser beams Ly, Lm and Lc are collimated by the collimator lens 30 and impinges upon the polygonal mirror 36 through the cylindrical lens 32 and the reflecting mirror 34. The polygonal mirror 36 is rotating at a high speed and the laser beams Ly, Lm and Lc are deflected by the polygonal mirror 36 to impinge upon the heat-sensitive recording material S through the fθ lens 38 and the cylindrical mirror 34, thereby simultaneously scanning the heat-sensitive recording material S in the direction of arrow A (main scanning).

The light energy of the laser beams Ly, Lm and Lc is converted into heat energy by the light absorbing dyestuffs 54y, 54m and 54c localized in the walls or near the walls of the micro-capsules 56y, 56m and 56c in the heat sensitive layer 48. The micro-capsules 56y, 56m and 56c are heated by the heat energy and when the temperatures of the micro-capsules 56y, 56m and 56c exceed the glass transition temperature, the micro-capsules 56y, 56m and 56c become permeable. As the temperature of the micro-capsules 56y, 56m and 56c become higher, the micro-capsules 56y, 56m and 56c become more permeable and the developing agent 58 which has been fluidized by the heat roll 22 enters the micro-capsules 56y, 56m and 56c in a predetermined amount and contacts with the color forming agents 52y, 52m and 52c, whereby color forming reaction occurs and a multicolored gradation image is formed.

The wavelengths of the laser beams Ly, Lm and Lc are set to correspond to the wavelengths λy, λm and λc of the respective light absorbing dyestuffs 54y, 54m and 54c. Accordingly, the light absorbing dyestuff 54y absorbs only the laser beam Ly and converts light energy of the laser beam Ly to heat energy. The permeability of the micro-capsules 56y is increased by the heat energy and the color forming agent 52y and the developing agent 58 react with each other in a predetermined amount, whereby a predetermined yellow color appears. Similarly the light absorbing dyestuff 54m absorbs only the laser beam Lm and converts light energy of the laser beam Lm to heat energy. The permeability of the micro-capsules 56m is increased by the heat energy and the color forming agent 52m and the developing agent 58 react with each other in a predetermined amount, whereby a predetermined magenta color appears. Further the light absorbing dyestuff 54c absorbs only the laser beam Lc and converts light energy of the laser beam Lc to heat energy. The permeability of the micro-capsules 56c is increased by the heat energy and the color forming agent 52c and the developing agent 58 react with each other in a predetermined amount, whereby a predetermined cyan color appears.

Thus in the second embodiment, the three laser beams Ly, Lm and Lc simultaneously scan the heat-sensitive recording material S to cause yellow, magenta and cyan to appear simultaneously. Accordingly, the recording time may be shorter and a high quality multi-colored image without bleeding can be obtained as compared with the case where the laser beams are separately caused to scan the heat-sensitive recording material S. Further since the light absorbing dyestuffs 54y, 54m and 54c are localized near the respective color forming agents 52y, 52m and 52c and are not dispersed in the developing agent 58, heat energy for developing a particular color does not develop another color, whereby a high quality multi-colored image without bleeding can be obtained.

Further since the light absorbing dyestuffs 54y, 54m and 54c which supply heat energy to the micro-capsules 56y, 56m and 56c are localized in or on the micro-capsules 56y, 56m and 56c, the light absorbing dyestuffs 54y, 54m and 54c effectively heat only the micro-capsules 56y, 56m and 56c without heating the developing agent 58 or the like more than necessary. Accordingly, the light energy from the laser beams Ly, Lm and Lc are very efficiently supplied to the micro-capsules 56y, 56m and 56c and contributes to development of colors.

Further since the heat-sensitive recording material S has been pre-heated to the temperature T1 (FIG. 6) by the heat roll 22, the laser diodes 28*y*, 28*m* and 28*c* need not be controlled in a wide temperature range between the room temperature of the place where the thermal recording device 120 is installed and the temperature T2 shown in FIG. 6. That is, the laser diodes 28*y*, 28*m* and 28*c* are controlled in the temperature range between the temperatures T1 and T2 and a high gradation image can be recorded with a high accuracy. Further since the laser diodes 28*y*, 28*m* and 28*c* need not output high power, the thermal recording device 120 can be simplified in structure and can be manufactured at low cost.

What is claimed is:

1. A thermal recording method for recording information on a heat-sensitive recording material comprising a photo-thermo conversion agent which converts supplied light energy into heat energy, a developing agent and a color forming agent which is encapsuled in micro-capsules whose permeability to materials increases with increase in said heat energy and forms a color by reaction with the developing agent wherein the improvement comprises the steps of localizing a photo-thermo conversion agent in and/or on micro-capsules, pre-heating the heat-sensitive recording material by supplying the heat-sensitive recording material with heat energy less than energy necessary to cause the heat-sensitive recording material to form a color and projecting onto the recording material with a light beam modulated according to the information to be recorded, thereby causing the heat-sensitive recording material to form a color in a predetermined density according to heat energy obtained from the light beam.

2. A thermal recording method as defined in claim 1 in which said photo-thermo conversion agent is mingled with the color forming agent in the micro-capsules.

3. A thermal recording method as defined in claim 1 in which said photo-thermo conversion agent is embedded in the walls of the micro-capsules.

4. A thermal recording method as defined in claim 1 in which said photo-thermo conversion agent is on the surface of the walls of the micro-capsules.

5. A thermal recording device for recording information on a heat-sensitive recording material comprising a photo-thermo conversion agent which converts supplied light energy into heat energy, a developing agent and a color forming agent which is encapsuled in micro-capsules whose permeability to materials increases with increase in said heat energy and forms a color by reaction with the developing agent wherein the improvement comprises a pre-heating means which pre-heats the heat-sensitive recording material in which a photo-thermo conversion agent is localized in and/or on the micro-capsules by supplying the heat-sensitive recording material with heat energy less than energy necessary to cause the heat-sensitive recording material to form a color and a light projecting means which projects onto the recording material a light beam modulated according to the information to be recorded, thereby causing the heat-sensitive recording material to form a color in a predetermined density according to heat energy obtained from the light beam.

6. A thermal recording method for recording information on a heat-sensitive recording material comprising a photo-thermo conversion agent which converts supplied light energy into heat energy, a developing agent and a color forming agent which is encapsuled in micro-capsules whose permeability to materials increases with increase in said heat energy and forms a color by reaction with the developing agent wherein the improvement comprises the steps of encapsulating different color forming agents separately in micro-capsules, localizing photo-thermo conversion agents which convert light energy of particular wavelengths separately in and/or on the micro-capsules containing therein the color forming agents corresponding to the wavelengths, pre-heating the heat-sensitive recording material by supplying the heat-sensitive recording material with heat energy less than energy necessary to cause the heat-sensitive recording material to form a color and projecting onto the recording material a plurality of light beams of said particular wavelengths modulated according to the information to be recorded, thereby causing the heat-sensitive recording material to form predetermined colors in predetermined densities according to heat energy obtained from the light beams.

7. A thermal recording method as defined in claim 6 in which each of said photo-thermo conversion agents is mingled with the corresponding color forming agent in the micro-capsules.

8. A thermal recording method as defined in claim 6 in which said photo-thermo conversion agent is embedded in the walls of the micro-capsules.

9. A thermal recording method as defined in claim 6 in which said photo-thermo conversion agent is on the surface of the walls of the micro-capsules.

10. A thermal recording device for recording information on a heat-sensitive recording material comprising a photo-thermo conversion agent which converts supplied light energy into heat energy, a developing agent and a color forming agent which is encapsuled in micro-capsules whose permeability to materials increases with increase in said heat energy and forms a color by reaction with the developing agent wherein the improvement comprises a pre-heating means which pre-heats the heat-sensitive recording material in which different color forming agents are separately encapsulated in micro-capsules, and photo-thermo conversion agents which convert light energy of particular wavelengths are separately localized in and/or on the micro-capsules containing therein the color forming agents corresponding to the wavelengths by supplying the heat-sensitive recording material with heat energy less than energy necessary to cause the heat-sensitive recording material to form a color, and a light projecting means which projects onto the recording material a plurality of light beams of said particular wavelengths modulated according to the information to be recorded, thereby causing the heat-sensitive recording material to form predetermined colors in predetermined densities according to heat energy obtained from the light beams.

* * * * *